US012714189B2

(12) United States Patent
De Jesus

(10) Patent No.: US 12,714,189 B2
(45) Date of Patent: Aug. 25, 2026

(54) SELECTIVELY REMOVABLE INSOLE FOR HIGH HEEL SHOES

(71) Applicant: Rosa De Jesus, Yonkers, NY (US)

(72) Inventor: Rosa De Jesus, Yonkers, NY (US)

( * ) Notice: Subject to any disclaimer, the term of this patent is extended or adjusted under 35 U.S.C. 154(b) by 0 days.

(21) Appl. No.: 17/982,654

(22) Filed: Nov. 8, 2022

(65) Prior Publication Data

US 2024/0148104 A1 May 9, 2024

(51) Int. Cl.

| | |
|---|---|
| ***A43B 13/16*** | (2006.01) |
| ***A43B 7/14*** | (2022.01) |
| ***A43B 7/149*** | (2022.01) |
| ***A43B 7/20*** | (2006.01) |
| ***A43B 13/04*** | (2006.01) |
| ***A43B 13/14*** | (2006.01) |
| ***A43B 21/00*** | (2006.01) |

(52) U.S. Cl.

CPC ..... *A43B 13/16* (2013.01); *A43B 7/149* (2013.01); *A43B 7/1495* (2013.01); *A43B 7/20* (2013.01); *A43B 13/04* (2013.01); *A43B 13/146* (2013.01); *A43B 21/00* (2013.01)

(58) Field of Classification Search

CPC ..... A43B 17/16; A43B 19/00; A43B 23/28; A43B 5/0405; A43B 23/07

USPC ..... 36/10

See application file for complete search history.

(56) References Cited

U.S. PATENT DOCUMENTS

| | | | | |
|---|---|---|---|---|
| 357,772 | A * | 2/1887 | Jones | A43B 23/28 36/10 |
| 1,930,188 | A * | 10/1933 | Gilbert | A61F 13/064 602/66 |
| 2,723,469 | A * | 11/1955 | Shusterman | A43B 3/30 36/1 |
| 2,917,843 | A | 12/1959 | Scholl | |
| 3,197,350 | A * | 7/1965 | Wedger | A43D 25/183 156/332 |
| 4,974,343 | A | 12/1990 | Davidson | |
| 5,154,682 | A | 10/1992 | Kellerman | |
| 7,140,125 | B2 | 11/2006 | Singleton et al. | |
| 8,800,170 | B1 | 8/2014 | Khaitan et al. | |

(Continued)

FOREIGN PATENT DOCUMENTS

| | | | | |
|---|---|---|---|---|
| WO | WO-9947014 A1 * | 9/1999 | ..... | A43B 1/0072 |
| WO | WO-2005077218 A1 * | 8/2005 | ..... | A43B 13/36 |

*Primary Examiner* — Grady Alexander Nunnery

(74) *Attorney, Agent, or Firm* — Mark C. Johnson; Johnson |Dalal

(57) ABSTRACT

A selectively removable insole for high heel shoes comprising an insole platform member of a flexible, deformable, and polymeric material, a toe strap of a transparent polymeric material, and a rear strap member formed with a side strap member portion and an ankle strap member portion. Embodiments of the invention provide a transparent silicone sock compromising a self-supporting material that flexes, stretches and covers parts of the foot that usually get affected by common foot problems such as, by way of example and without limitation, skin irritation, blisters, skin stiffening, calluses, plantar forefoot pain at the forefoot, and metatarsalgia during fashionable, open or close toed, high heel shoe wear. Beneficially, a user can make any high heeled shoe, sandal, or boot that they already own or wish to purchase comfortable to wear for prolonged periods of time without foot pain or discomfort.

17 Claims, 7 Drawing Sheets

(56) References Cited

U.S. PATENT DOCUMENTS

| | | | | |
|---|---|---|---|---|
| 9,693,602 | B2 | 7/2017 | Trautmann | |
| 9,924,764 | B2 | 3/2018 | Cazarez | |
| 10,582,738 | B2 * | 3/2020 | Pellegrino | A43B 3/242 |
| 2004/0194344 | A1 | 10/2004 | Tadin | |
| 2004/0194348 | A1 | 10/2004 | Campbell et al. | |
| 2005/0016032 | A1 * | 1/2005 | Cox | A43B 3/12 36/132 |
| 2006/0207124 | A1 * | 9/2006 | Dana, III | A43B 1/0072 36/8.4 |
| 2007/0107258 | A1 * | 5/2007 | Umezawa | A43B 7/1445 36/28 |
| 2008/0250669 | A1 * | 10/2008 | Hallivis | A43B 7/00 36/88 |
| 2010/0101112 | A1 * | 4/2010 | Powaser | A43B 1/0072 36/43 |
| 2011/0067268 | A1 * | 3/2011 | Lubart | A43B 13/026 36/35 B |
| 2012/0260534 | A1 * | 10/2012 | Guer | A43C 15/02 36/134 |
| 2013/0081303 | A1 * | 4/2013 | Zubizarreta | A43B 3/163 36/43 |
| 2014/0033565 | A1 * | 2/2014 | Aruin | A43B 7/149 36/43 |
| 2014/0196306 | A1 * | 7/2014 | Gill | A43B 17/00 36/10 |
| 2015/0201702 | A1 * | 7/2015 | Paul | A43B 7/1445 12/146 B |
| 2016/0150852 | A1 | 6/2016 | Cai | |
| 2018/0168278 | A1 | 6/2018 | Saint Dunbar et al. | |
| 2020/0170335 | A1 * | 6/2020 | Horvath | A43B 3/0047 |
| 2020/0275732 | A1 * | 9/2020 | Crary | A43B 1/0018 |

* cited by examiner

SELECTIVELY REMOVABLE INSOLE FOR HIGH HEEL SHOES

FIELD OF THE INVENTION

The present invention relates generally to foot orthotics, shoe inserts, foot insoles, cushioning pads, and protective garments for the foot in the form of hosiery, socks, self-adhering membranes, and shoe inserts and, more specifically, to foot care products that improve shoe comfort, foot skin protection, and supply performance enhancement, including improved posture. The invention also relates to silicone gel materials and the process used to fabricate such materials.

BACKGROUND OF THE INVENTION

The adverse biomechanical changes that occur on a foot positioned in a high-heeled shoe have been studied and discussed. Adverse effects of high-heel shoe wear are commonly experienced by people, typically women, in the form of general pain and discomfort and more prevalent foot problems. Regular high-heeled shoe wear is a known cause of common foot problems such as, for example, skin irritation, blisters, skin stiffening, calluses, plantar forefoot pain at the forefoot, and metatarsalgia. A study by Damson et. al. (2002) reports eighty three percent (83%) of foot problems are seen in women ages 50-70 who regularly wear high-heeled shoes. It has been recommended that women not wear a heel height greater than 5 cm (about 2 inches), yet most fashionable high-heeled shoes are higher than this figure (Ebbeling et. al., 1994). Despite the pain experienced by women, the desire to be fashionable and look professional leave the high-heeled shoe a commonplace shoe choice. It has been reported that 59% of women wear high-heeled shoes between one to eight hours a day (Gallop Org., 1986).

Many women cannot wear high heeled footwear for exceptionally prolonged periods of time without discomfort due to foot pain. It is a common sight to see women taking off their high heeled footwear and changing to lower heels for activities such as dancing or extended walking or arranging their wearing of high heels for only short periods of time or to outings where they predict they will not need to walk or stand in their high heels for an extended period. Many women have pairs of high heeled footwear that they can only wear for extremely limited amounts of time or have had to abandon altogether, and some women do not wear high heels at all due to the discomfort but would like to wear them because high heeled shoes are fashionable and attractive footwear.

High heeled shoes are problematic to wear comfortably because when high heels are worn the foot is placed at an angle from between 20 degrees to over 30 degrees to the ground. Gravity causes the foot to slide downward and forward in the shoe crushing the toes and forefoot and making the heel area of the shoe unstable. An added discomfort is from most of the weight of the wearer being borne by the balls of the feet, the metatarsal heads. The discomfort for the wearer from the forward slide of the foot, shoe instability and weight on the balls of the feet becomes more problematic the higher the heel of the shoe compared to the sole of the shoe, and the length of time that the footwear is worn. The forward slide of the foot in a high heel shoe creates two problems for the wearer. The first problem occurs when the toes of the wearer become crushed due to the foot sliding forward pushing against the front and sides of the closed toe box or into the straps of a high heel sandal.

Prolonged wearing of high heeled footwear can cause vulnerable people severe foot problems from the crushing of the forefoot leading to medical conditions of bunions, hammertoes and Morton's neuroma or plantar neuroma. In addition, in peep toe shoes and in sandals one or more of the wearer's toes overhang the soles of the shoe from the front opening of the shoe. This is uncomfortable for the wearer and not a flattering look.

Further, as individuals often choose to wear shoes without socks or other comparable garments, there may be added abrasions incurred on the front of the foot where the anterior rim of the shoe crosses the wearer's metatarsals, the metatarsal phalangeal joints, or the phalanges. A similar type of abrasive injury can occur along the posterior interior rim of the shoe as it crosses the Achilles tendon and extends around the ankle or foot. Further injury can occur in these areas by the continued motion of the foot during ambulation. Often, those who experience this trauma resort to placing bandages in various locations on the foot in a feeble attempt to protect from further injury.

There are existing, prior art solutions that attempt to tackle the problem of discomfort felt by high heel wearers by supplying full or partial insoles. There are special custom-made full foot insoles that have various features such as a built-up cupped area around the heel to stabilize the heel, support under the arch area to stabilize the foot and transfer some of the weight off the ball of the foot and added cushioning under the ball of the foot. One full foot insole design has a ridge made of soft material across the insole from side to side in the forefoot area to stop the forefoot from sliding forward in either high or low heels. This design also has cushioning under all the toes.

Another full foot custom insole is cast from a mold made from the bottom of an individual's foot placed in a specific high heel position. The insole is made of hard material that is precisely molded to the bottom of the foot and the desired height of heel. When it is manufactured into a shoe for the individual for whom it is designed the molded hard material insole effectively holds the foot in place at many points in the high heel shoe such as at the areas of the heel, instep and forefoot. It can be used as a semi-customized insole by others who have the same size foot, and the same heel height if they also have the same foot configuration such as length of toes and angle of ball of the foot, and height of the arch of their foot.

Some existing art insoles are partial insoles that involve the heel, instep and ball of the boot in one piece, or just the heel and the instep area in one piece, or just the instep and the ball of the foot area in one piece. The heel area feature is for cushioning the heel and adding stability, the instep feature is to supply stability support at the instep and to take some weight off the ball of the foot, and the ball of the foot feature is to add cushioning under the ball of the foot.

There are existing solutions that tackle the problem of discomfort felt by high heel wearers by specially made inserts. There are inserts for the heel area only, the arch area only, for the ball of the foot only, and for the ball of the foot plus the forefoot area under the toes that is made to be worn only with sandals. The features of the inserts address the same areas of discomfort respectively as the whole and partial insoles. The insert that is worn only with sandals has a ridge that goes across the forefoot are a to prevent the toes from sliding forward and overhanging the front of the sandal.

Existing prior art, including that discussed above, is characterized by significant limitations. Individual inserts do not stabilize the foot at both the heel and forefoot because they function only in one area of the foot, and because of inability to stabilize the foot the inserts lose their effectiveness and/or comfort in the spot that they are designed for when the foot moves out of the best position. Shortcomings of currently available high heel inserts are that they only partially solve some of the discomfort of some high heel footwear for some people. Removable inserts can become displaced easily because of not being glued down sufficiently or being made of material that is too soft and crushes, so it does not hold back the force of the foot or is too hard and causes discomfort underfoot. If the insert extends outside of the naturally occurring spaces under a foot, it is too bulky to fit in closed high heel shoes and is visible and obvious in sandals. Inserts made to be placed under the ball of the foot are effective in cushioning that area but may be obtrusive if they extend too far out from under the ball of the foot or are too thick and therefore cause discomfort under the vamp of closed shoes. Inserts placed under the arch of the foot alleviate some of the pressure from the ball of the foot by putting added pressure on the arch, however that may be experienced as uncomfortable with lower heights of heels and be ineffective with extremely high heels as the arch insert is available only in one height while arching of the foot increases with the height of heel.

Currently there is nothing available that is highly effective in making high heeled footwear comfortable to wear that is adjustable to the individual wearer by the individual wearer, comfortable over many hours of wear, unobtrusive (i.e., visually minimally perceptible to the naked eye), and fits all sizes and configurations of feet, all high heel heights from 2½ inches to 4+ inches and all styles of shoes such as sandals, closed shoes such as pumps, partially open shoes such as peep toes that are open at the toes, or sling backs that are open at the heel, and high heeled boots.

Therefore, a need exists to overcome the problems with the prior art as discussed above.

SUMMARY OF THE INVENTION

The invention provides a selectively removable insole for high heel shoes that overcomes the hereinafore-mentioned disadvantages of the heretofore-known devices and methods of this general type and that consists of a comfortable and versatile insole that can be selectively affixed to any high heel shoe to make the shoe more comfortable and less painful to wear, particularly for prolonged periods of time.

With the foregoing and other objects in view, there is provided, in accordance with the invention, an insole for high heel shoes comprising an insole platform member of a flexible, deformable, and polymeric material, having a front end, a rear end, defining an insole platform member length separating the front and rear ends of the insole platform member, having two opposing sides defining an insole platform member width separating the two opposing sides, having an insole upper surface, an insole bottom surface opposing the insole upper surface, defining an insole thickness separating the insole upper surface and insole bottom surface and of a slender configuration relative to the insole platform member length and the insole platform member width; a toe strap disposed proximal to the front end, defining an enclosed opening, and of a transparent polymeric material; and a rear strap member directly uncoupled to the toe strap and formed with a side strap member portion disposed proximal to the rear end, disposed on the opposite sides of the insole platform member, and of a transparent polymeric material, and an ankle strap member portion coupled to an upper end of the side strap member portion, defining an enclosed opening, and of a transparent polymeric material.

In accordance with a further feature of the present invention, the insole platform member is of a monolithic latex rubber material.

In accordance with another feature of the present invention, the insole thickness is less than approximately 5 mm uniformly spanning the platform member length.

In accordance with yet another feature of the present invention, the insole platform member is formedly biased into a first planar portion and a second continually curved portion angled relative to the first planar portion, the first planar portion including the front end and the second curved portion including the rear end.

In accordance with another feature, the insole platform member further comprises a plurality of raised surfaces each radially projecting from the insole upper surface, each of a spherical shape, disposed in a tightly spaced configuration with respect to one another, and continuously and substantially spanning the insole platform member length.

In accordance with a further feature of the present invention, the side strap member portion and the ankle strap member portion are each of a thickness less than approximately 5 mm and a width separating opposing sides less than approximately 30 mm.

In accordance with another feature, the insole bottom surface insole platform member further defines a toe strap recess shaped and sized to receive the toe strap in a completely recessed configuration therein; and a side strap recess shaped and sized to receive the side strap member portion in a completely recessed configuration therein.

In accordance with yet another feature, the rear strap member has a heel strap member portion and with a thin side clear plastic connecting both the side strap member portion, the heel strap member portion, and the ankle strap member portion.

In accordance with another feature, an embodiment of the present invention includes a side support member disposed on the insole platform member at the midpoint of the insole platform member length.

Although the invention is illustrated and described herein as embodied in a selectively removable insole for high heel shoes, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the insole.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
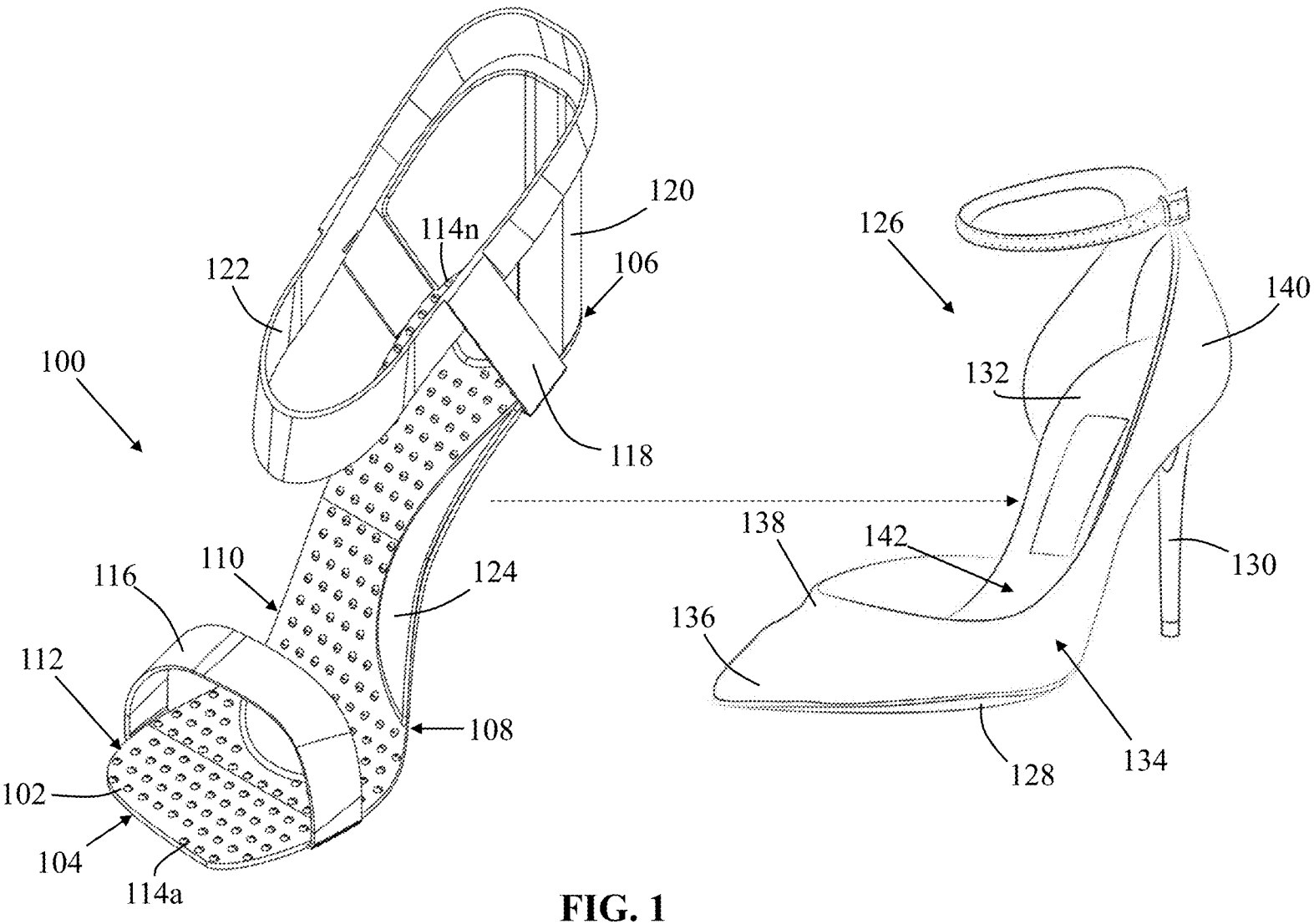
FIGS. 1-3 depict perspective top views of an insole for high heel shoes, in accordance with the present invention, wherein FIG. 1 also depicts an exemplary high heel shoe for use with the insole.
Figure 2:
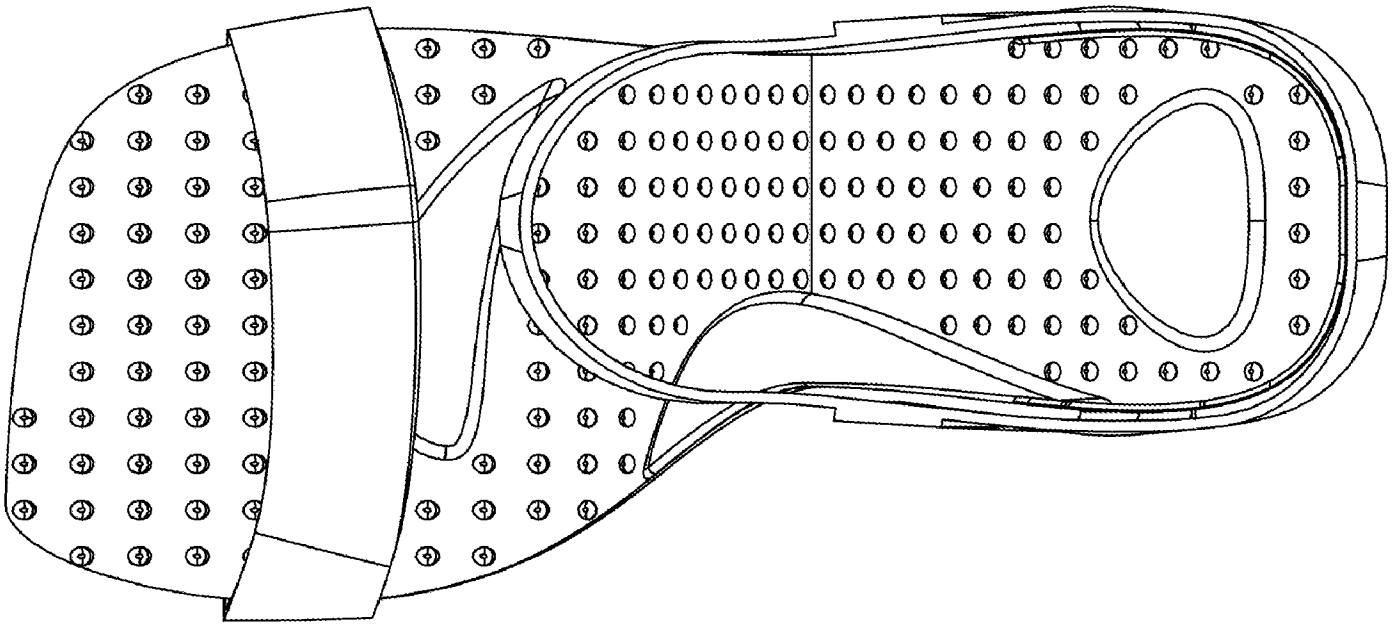

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient insole for high heel shoes that is designed to be worn like a silicone sock such that it is not immediately or readily visually perceptible to others at first glance. Embodiments of the invention provide an insole that helps supply comfort and support to the foot during fashionable high-heel shoe wear. In addition, embodiments of the invention provide a transparent silicone sock compromising a self-supporting material that flexes, stretches and covers parts of the foot that usually get affected by common foot problems such as, by way of example and without limitation, skin irritation, blisters, skin stiffening, calluses, plantar forefoot pain at the forefoot, and metatarsalgia during fashionable, open or close toed, high heel shoe wear. Beneficially, the present invention enables users to comfortably wear high heeled footwear of all styles and heel heights that can be purchased from widely available shoe and retail stores. A user can make any high heeled shoe, sandal, or boot that they already own or wish to purchase comfortable to wear for prolonged periods of time without foot pain or discomfort.

Existing prior art focuses on and protects only one part of the foot at a time, creating comfort on that specific part of the foot only. Conversely, the present invention focuses on and protects different areas of the foot that are regularly affected by high heel shoe wear, like toes, ball, sole, bridge, heel, and ankle. Moreover, the present invention focuses not only on creating comfort for the foot, but it also focuses on the cosmetic look of the shoe by comprising a design and material that is not readily noticeable at first glance while other related prior art is too noticeable, thereby detracting from the cosmetic, fashionable look of certain shoes.

The present invention also prevents the user from being required to use different pieces on each part of the foot that might be affected by high heel shoe wear, thereby helping prevent alterations on the shoe size and malfunctions that can happen when wearing different pieces in different parts of the foot, e.g., such as the discomfort, frustration, and annoyance that a user experiences when pieces peel off or move out of position due to detachment. Beneficially, the present invention provides the user the convenience of a one-piece sock that has the same mechanism of a conventional sock, but with the advantage that is not noticeable to others at first glance. Moreover, the material is more resistant to the friction and rubbing of a shoe material that causes the hereinabove referenced foot problems.

Another benefit of the present invention is that because of its measurements and the elasticity of the material, it conforms to the foot, preventing the original shoe size from being altered and that, in turn, prevents the user from experiencing discomfort from a tight shoe. Unlike existing prior art, the insole is a one-piece device that covers all the parts of the foot that usually get affected by high heel shoe wear, giving the user the convenience of simplicity and practicality. An example of another similar prior art is that embodied in Patent No. CA2812560A1 that supplies comfort for high heel shoe wearers with two separate inserts which are a forefoot insert under three middle toes and an arch insert that is highest and widest just in front of the heel. The prior art, however, forces the user to wear multiple separate and discrete pieces at one time, rather than a single monolithic body which is easier and faster to use and more comfortable on the foot.

Referring now to FIG. 1, one embodiment of the present invention is shown in a perspective top view. FIG. 1 shows several advantageous features of the present invention, but, as will be described below, the invention can be provided in several shapes, sizes, combinations of features and components, and varying numbers and functions of the components. The first example of an insole for high heel shoes 100 (referred to hereinafter as "insole 100" for brevity), as shown in FIG. 1, includes an insole platform member 102 of a flexible, deformable, and polymeric material, having a front end 104, a rear end 106, defining an insole platform member length 300 separating the front and rear ends 104, 106 of the insole platform member 102, having two opposing sides 108, 110 defining an insole platform member width 700 separating the two opposing sides 108, 110, having an insole upper surface 112, an insole bottom surface 302 opposing the insole upper surface 112, defining an insole thickness separating the insole upper surface 112 and insole bottom surface 302 and of a slender configuration relative to the insole platform member length 300 and the insole platform member width 700. As used herein, "flexible" is defined as capable of bending easily without breaking, and "deformable" is defined as capable of being reshaped. The foregoing material properties of the insole platform member 102 are crucial because they preserve the versatility of the insole 100 by ensuring that the insole 100 can easily and successfully be applied to different high heel shoes, boots, sandals, etc. Moreover, these properties provide for a surface that is comfortable to the user's feet, particularly when the user places the weight of their body on the insole platform member 102. It is also important that the insole platform member 102 is of a polymeric material that typically embodies the foregoing properties and characteristics. In a preferred embodiment, the insole platform member 102 is of a monolithic latex rubber material. Latex is known for its tensile and elongation abilities, as well as tear resistance and overall resilience, creating a comfortable and durable surface for the insole 100. In an exemplary embodiment, the insole platform member 102 is formed from liquid latex which is naturally sticky or tacky even when it dries. One advantage to the tackiness of liquid latex is that it can act as an adhesive for attaching items such as the insole 100 to a shoe. Moreover, liquid latex is naturally clear and dries into a translucent amber color which is beneficial insofar as the insole 100 is not as readily perceptible to the naked eye as it would be if composed of a different material composition. In alternate embodiments, the insole platform member 102 may be composed of a different, yet comparable, material composition that likewise embodies the foregoing properties, qualities, and/or characteristics. Importantly, the insole platform member 102 is monolithic in a preferred embodiment to avoid the discomfort and inconvenience of use associated with wearing or using multiple pieces to achieve the same function as well as the danger arising from pieces peeling off, falling off, or dislodging.

Figure 3:
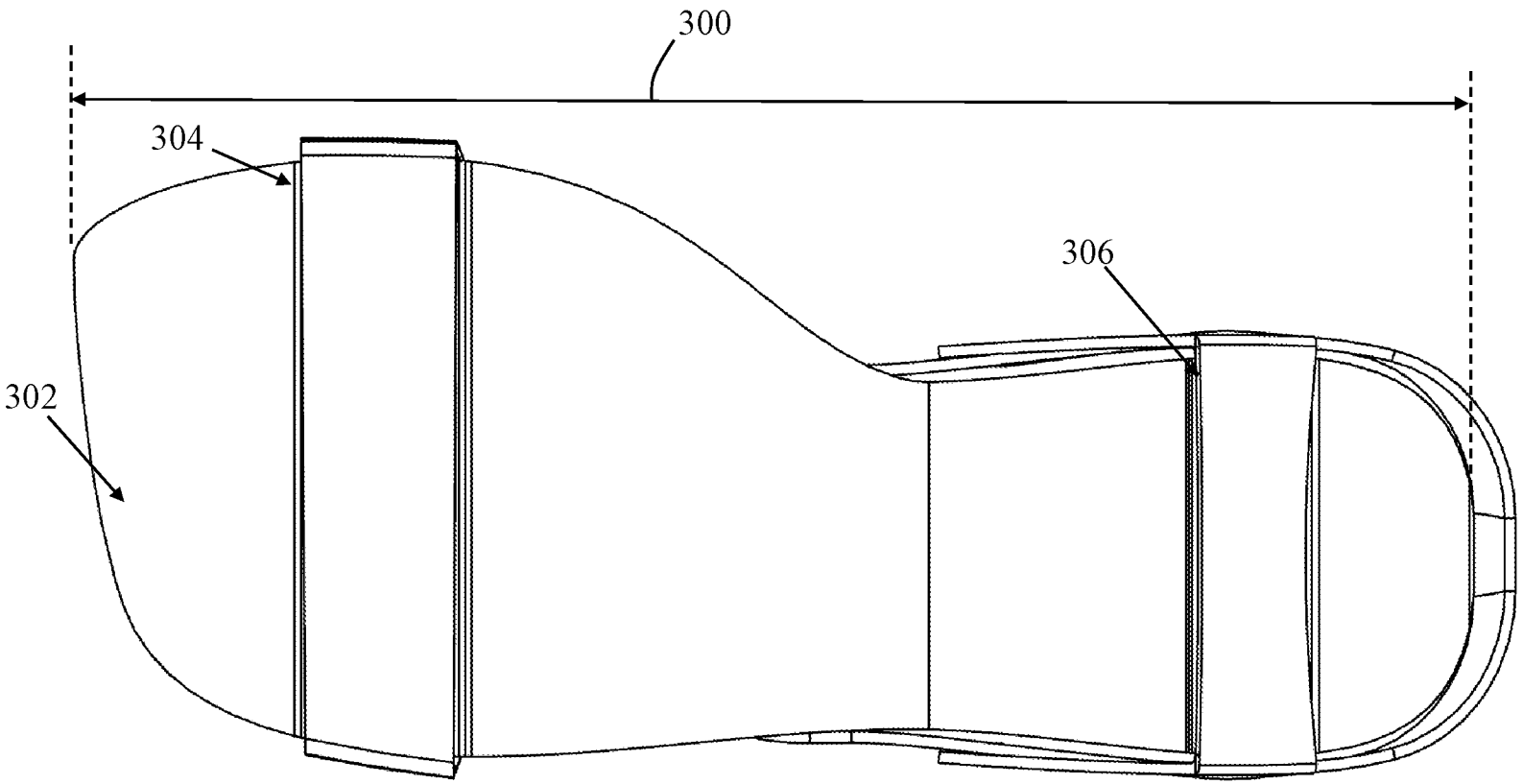
Figure 5:
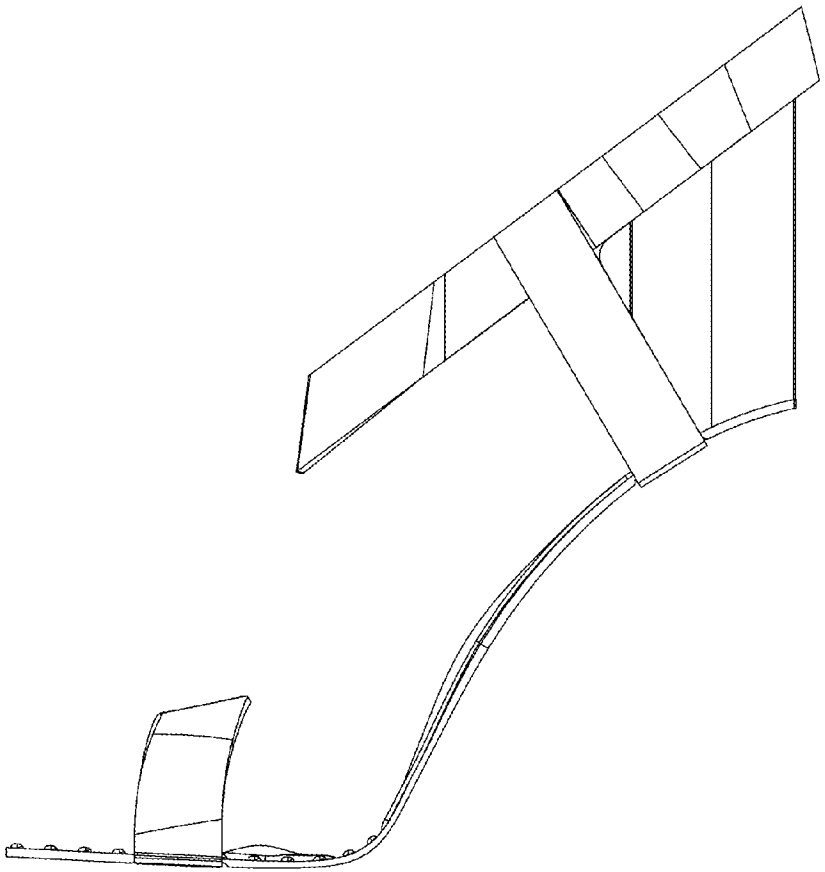
FIGS. 4-5 depict elevational side views of the insole for high heel shoes according to FIG. 1, in accordance with the present invention.
Figure 4:
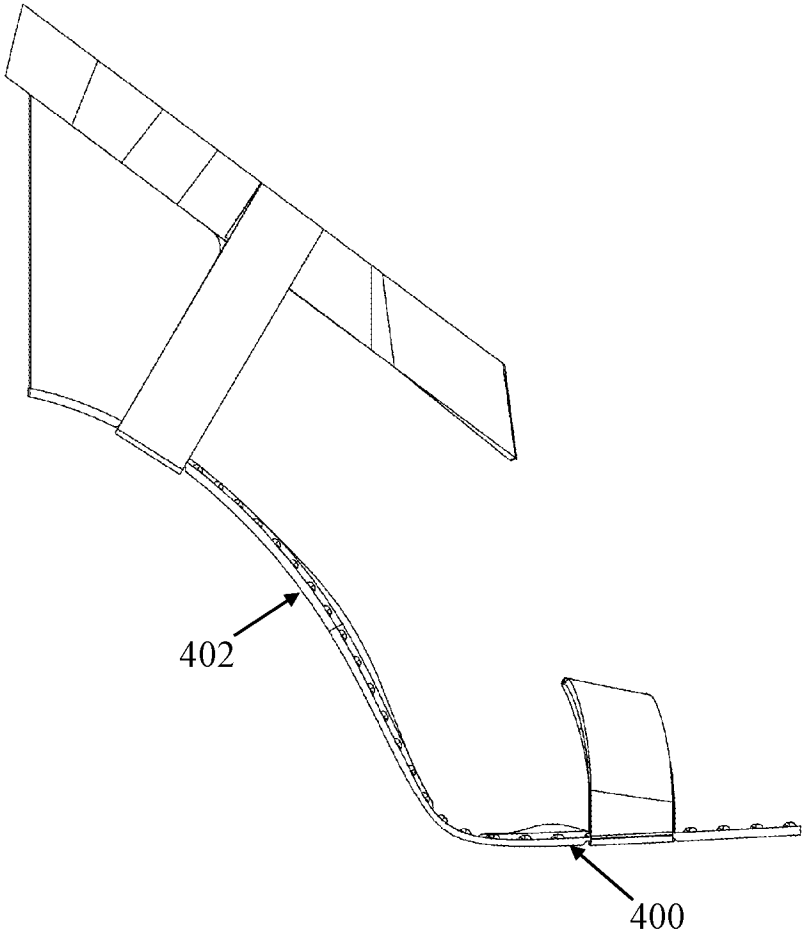
Figure 7:
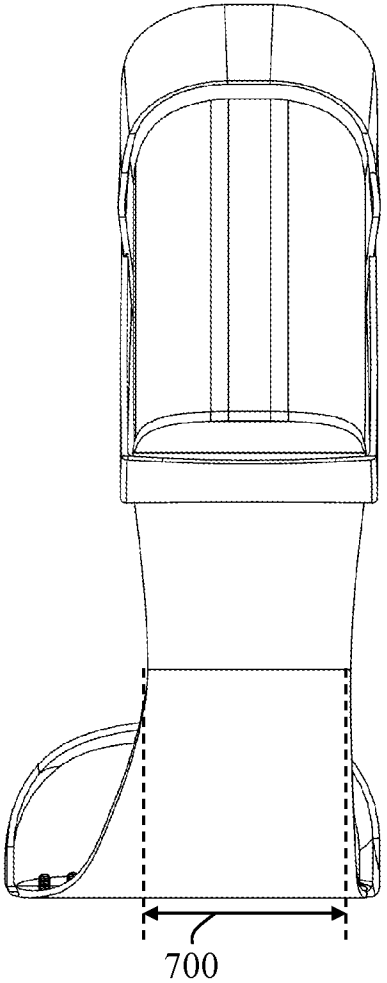
FIGS. 6-7 depict elevational front and rear views of the insole for high heel shoes, in accordance with the present invention.
Figure 6:
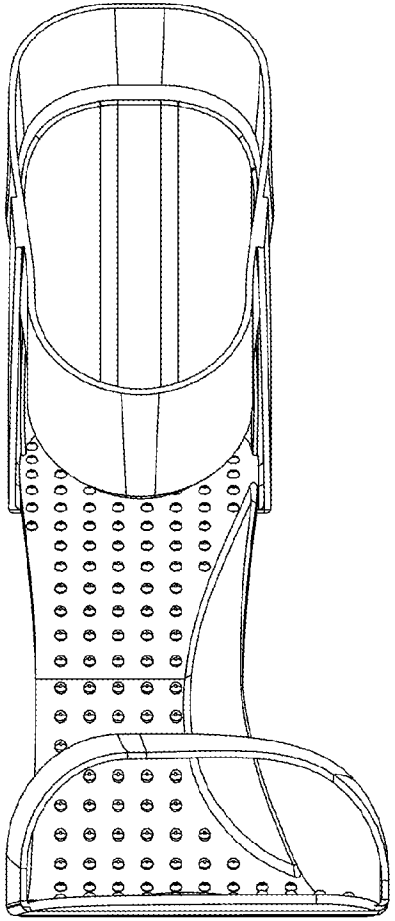
Figure 8:
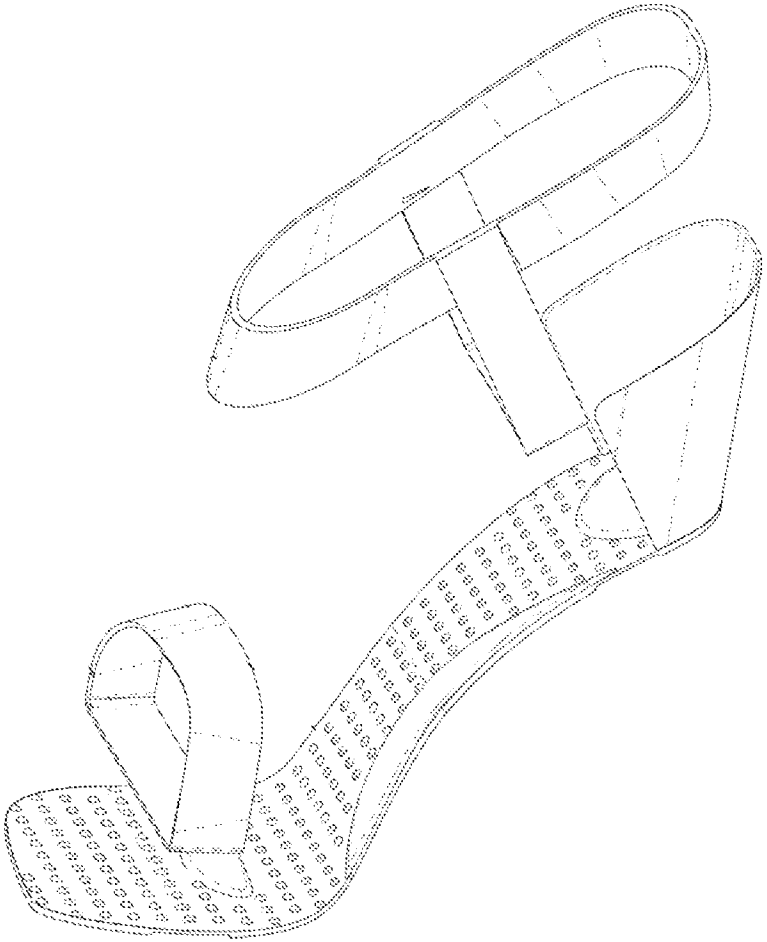
FIG. 8 is a perspective side view of the insole for high heel shoes, in accordance with the present invention.

The insole platform member length 300 (depicted in FIG. 3) is of a length corresponding to the average length of a user's foot to beneficially enable use by users of varying shoe and foot sizes. An exemplary insole platform member length 300 is approximately 184.658 mm though the insole platform member length 300 may vary in alternate embodiments. For example, the insole 100 may be one-size-fits-all (or one-size-fits-most) or may come in different sizes such that the insole platform member length 300 corresponds to different shoe sizes. Regardless, the insole platform member length 300 should not be excessively long as it would not facilitate a sufficiently snug fit of the insole 100 around the user's foot. Likewise, the insole platform member width 700 (depicted in FIG. 7) should correspond in size and dimension to the width of the user's foot. In an exemplary embodiment, the insole platform member width 700 ranges between approximately 78.232 mm at the front end 104 of the insole platform member 102 and 56.388 mm at the rear end 106 of the insole platform member 102.

Figure 9:
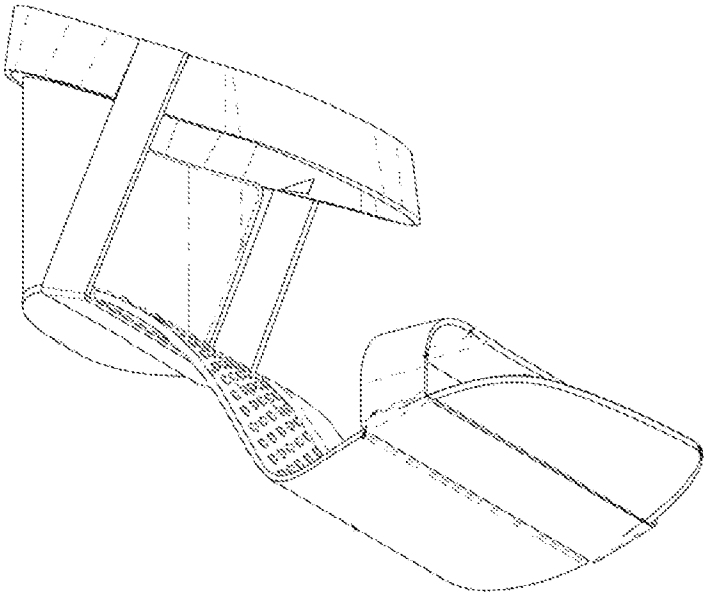
FIG. 9 is a perspective bottom view of the insole for high heel shoes, in accordance with the present invention.

The insole 100 further comprises a toe strap 116 disposed proximal to the front end 104, defining an enclosed opening, and of a transparent polymeric material. As used herein, "proximal to" is defined as being at or near, within 25-50 millimeters or less than 10% of the overall insole platform member length 300. The enclosed opening is ideally enclosed using the insole upper surface 112 because a portion of the toe strap 116 is disposed underneath the insole platform member 102 (as best depicted in FIG. 9). As used herein, "transparent" is defined as clear or see-through and also includes, unless otherwise specified, translucent (i.e., semi-transparent) materials, but does not include any opaque material(s) because the insole 100 would then be easily noticed, defeating one of the principal purposes of the present invention.

In accordance with another feature, the insole 100 further comprises a rear strap member 118, 120, 122 directly uncoupled to the toe strap 116 and formed with a side strap member portion 118 disposed proximal to the rear end 106, disposed on the opposite sides 108, 110 of the insole platform member 102, and of a transparent polymeric material; and an ankle strap member portion 122 coupled to an upper end of the side strap member portion 118, defining an enclosed opening, and of a transparent polymeric material. The side strap member portion 118 may be formed with two separate strap portions or a single strap portion. The enclosed opening defined by the ankle strap member portion 122 is operably configured and designed to receive the user's ankle therein which beneficially secures the insole 100 to, and around, the user's foot to avoid or prevent inadvertent dislodging. The side strap member portion 118 is approximately 18.288 mm in length though this length may vary in alternate embodiments.

The insole thickness is less than approximately 5 mm (+/−1 mm) uniformly spanning the platform member length 300. This beneficially provides sufficient support and cushion to the user upon each foot strike while simultaneously keeping a low footprint that allows the insole 100 to fit within various types of high heel shoes, boots, sandals, and other footwear.

In one embodiment, the insole platform member 102 is formedly biased into a first planar portion 400 and a second continually curved portion 402 angled relative to the first planar portion 400, the first planar portion 400 including the front end 104 and the second curved portion 402 including the rear end 106. Said differently, the manufacturing process for the insole 100 forms it into the form and shape depicted in the attached figures such that it is biased in said shape (e.g., by heat pressing the second curved portion 402 relative to the first planar portion 400).

The insole platform member 102 may further comprise a plurality of raised surfaces 114*a-n* (wherein "n" refers to any number greater than one) each radially projecting from the insole upper surface 112, each of a spherical shape, disposed in a tightly spaced configuration with respect to one another, and continuously and substantially spanning the insole platform member length 300. In an exemplary embodiment, each of the plurality of raised surfaces 114*a-n* are approximately 3 mm or less in height, 3 mm or less in diameter, and spaced less than 5 mm apart from one another. The plurality of raised surfaces 114*a-n* span at least 70% of the insole platform member length 300 and the insole platform member width 700 of the insole platform member 102. Beneficially, the plurality of raised surfaces 114*a-n* provide comfort and support to the user's foot and facilitate the circulation of air between the user's foot and the insole platform member 102. As seen best in FIGS. 1-3 and FIG. 7, the insole upper surface 112 can also be seen enclosed by the two opposing sides 108, 110 of the insole platform member 102 continuously spanning both the insole platform member width 700 and the insole platform length 300 for placement of the user's foot.

For greater comfort and ease of use (along with visual aesthetics), the side strap member portion 118 and the ankle strap member portion 122 are each of a thickness less than approximately 5 mm and a width separating opposing sides less than approximately 30 mm. These dimensions are also significant because they ensure the inconspicuous nature of the insole 100. In accordance with a further feature of the present invention, the insole bottom surface 302 of the insole platform member 102 further defines a toe strap recess 304 shaped and sized to receive the toe strap 116 in a completely recessed configuration therein; and a side strap recess 306 shaped and sized to receive the side strap member portion 118 in a completely recessed configuration therein. The rear strap member 118, 120, 122 may have a heel strap member portion 120 and with a thin side clear plastic connecting both the side strap member portion 118, the heel strap member portion 120, and the ankle strap member portion 122. The clear and thin nature of the plastic connecting the side strap member portion 118, the heel strap member portion 120, and the ankle strap member portion 122 further contributes to the visually imperceptible or inconspicuous nature of the insole 100. Still referring to FIG. 1, the toe strap 116 can be seen disposed proximal to and spaced apart from the front end 104 of the insole platform member 102 and that defines the enclosed opening that is accessible from both sides of the toe strap 116 facing the front and the rear ends 104, 106, respectively, of the insole platform member 102.

A side support member 124 is disposed on the insole platform member 102 at the midpoint of the insole platform member length 300, i.e., at or within 50% of the insole platform member length 300. The placement of the side support member 124 at the midpoint of the insole platform member length 300 allows the side support member 124 to provide greater support and cushion to the midfoot of the user for improved balance. With reference back to FIG. 1, the insole for high heel shoes 100 can be seen configured to be utilized with a high heel shoe 126 having an outsole 128, a cantilevered heel member 130 extending from the outsole 128, an insole 132 opposing the outsole 128 of the high heel shoe 126, and an upper member 134. The insole 132 and outsole 128 may be also preformed into the acute orientation or angle shown in FIG. 1. The insole bottom surface 302 is selectively removably directly coupled to the insole 132 of the high heel shoe 126 (as indicated by the arrow) such that the insole bottom surface of the insole platform member 102 is selectively removably directly coupled to shoe insole upper surface 142 of the insole 132. The high heel shoe 126, namely the upper member 134, may include a toe box 136 terminating at a vamp 138 and may also include a quarter 140 or counter configured to support a heel of a user.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. An insole for high heel shoes comprising:

an insole platform member of a flexible, deformable, and polymeric material, having a front end, a rear end, defining an insole platform member length separating the front and rear ends of the insole platform member, having two opposing sides defining an insole platform member width separating the two opposing sides, having an insole upper surface enclosed by the two opposing sides of the insole platform member continuously spanning both the insole platform member width and the insole platform member length for placement of a user's foot, an insole bottom surface opposing the insole upper surface and defining a toe strap recess, defining an insole thickness separating the insole upper surface and insole bottom surface and of a slender configuration relative to the insole platform member length and the insole platform member width;

a toe strap disposed proximal to and spaced apart from the front end of the insole platform member, with a portion spanning the insole platform member width over the insole upper surface to define an enclosed opening that is open toward the front end and open toward the rear end for entry and removal of a user's foot through the enclosed opening, of a transparent polymeric material, and a portion spanning the entire insole platform member width between the two opposing sides of the insole platform member over the insole bottom surface and disposed in a completely recessed configuration within the toe strap recess; and a rear strap member directly uncoupled to the toe strap and comprising:

two side strap members disposed proximal to the rear end, each disposed on one respective side of the two opposing sides of the insole platform member, and of a transparent polymeric material; and an ankle strap member coupled to upper ends of the side strap members, defining an enclosed opening, and of a transparent polymeric material.

2. The insole for high heel shoes according to claim 1, wherein:

the insole platform member is of a monolithic latex rubber material.

3. The insole for high heel shoes according to claim 1, wherein:

the insole thickness is less than 5 mm uniformly spanning the insole platform member length.

4. The insole for high heel shoes according to claim 1, wherein;

the insole platform member is formerly biased into a first planar portion and a second continually curved portion angled relative to the first planar portion, the first planar portion including the front end and the second curved portion including the rear end.

5. The insole for high heel shoes according to claim 1, wherein the insole platform member further comprises:

a plurality of raised surfaces each radially projecting from the insole upper surface, each of a spherical shape, disposed in a tightly spaced configuration with respect to one another, and continuously and substantially spanning the insole platform member length.

6. The insole for high heel shoes according to claim 1, wherein;

the side strap members and the ankle strap member are each of a thickness less than 5 mm and a width separating opposing sides of each of the side strap members less than 30 mm.

7. The insole for high heel shoes according to claim 1, wherein the insole bottom surface of the insole platform member further defines:

a side strap recess shaped and sized to receive the side strap members in a completely recessed configuration therein.

8. The insole for high heel shoes according to claim 1, wherein:

the rear strap member has a heel strap member and a thin side transparent plastic connecting both the side strap members, the heel strap member, and the ankle strap member.

9. The insole for high heel shoes according to claim 1, further comprising:

a side support member disposed on the insole platform member at the midpoint of the insole platform member length.

10. A selectively removable insole for a shoe comprising:

an outsole for placement on a ground surface, an insole opposing the outsole and having an insole upper surface for placement for a user's foot, and an upper member disposed laterally around the insole;

an insole platform member of a flexible, deformable, and polymeric material, having a front end, a rear end, defining an insole platform member length separating the front and rear ends of the insole platform member, having two opposing sides defining an insole platform member width separating the two opposing sides, having an insole platform member upper surface enclosed by the two opposing sides of the insole platform member continuously spanning both the insole platform member width and the insole platform member length for placement of the user's foot, inserted within the upper member with the insole platform member having an insole platform member bottom surface opposing the insole platform member upper surface and defining a toe strap recess, the insole platform member bottom surface selectively removably directly coupled to the insole upper surface, defining an insole platform member thickness separating the insole platform member upper surface and the insole platform member bottom surface and of a slender configuration relative to the insole platform member length and the insole platform member width;

a toe strap disposed proximal to and spaced apart from the front end, with a portion spanning the insole platform member width over the insole platform member upper surface to define an enclosed opening that is open toward the front end and open toward the rear end for entry and removal of the user's foot through the enclosed opening, and of a transparent polymeric material, and a portion spanning the entire insole platform member width between the two opposing sides of the insole platform member over the insole platform member bottom surface and disposed in a completely recessed configuration within the toe strap recess; and a rear strap member directly uncoupled to the toe strap and comprising:

two side strap members disposed proximal to the rear end, each disposed on one respective side of the two opposing sides of the insole platform member, and of a transparent polymeric material.

11. The shoe according to claim 10, wherein:

the insole platform member is of a monolithic latex rubber material.

12. The shoe according to claim 10, wherein:

the insole platform member thickness is less than 5 mm uniformly spanning the insole platform member length.

13. The shoe according to claim 10, wherein:

the insole platform member is formedly biased into a first planar portion and a second continually curved portion angled relative to the first planar portion, the first planar portion including the front end and the second curved portion including the rear end.

14. The shoe according to claim 10, wherein the insole platform member further comprises:

a plurality of raised surfaces each radially projecting from the insole platform member upper surface, each of a spherical shape, disposed in a tightly spaced configuration with respect to one another, and continuously and substantially spanning the insole platform member length.

15. The shoe according to claim 10, wherein:

the side strap members and an ankle strap member coupled to upper ends of the side strap members are each of a thickness less than 5 mm and a width separating opposing sides of each of the side strap members is less than 30 mm, the ankle strap member of a transparent polymeric material.

16. The shoe according to claim 10, wherein the insole platform member bottom surface of the insole platform member further defines:

a side strap recess shaped and sized to receive the side strap members in a completely recessed configuration therein.

17. The shoe according to claim 10, wherein:

the rear strap member has a heel strap member and a thin side transparent plastic connecting both the side strap members, the heel strap member, and an ankle strap member-portion coupled to upper ends of the side strap members, the ankle strap member of a transparent polymeric material.

* * * * *